US005375664A

United States Patent [19]

McDowell et al.

[11] Patent Number: 5,375,664

[45] Date of Patent: Dec. 27, 1994

[54] PILE DRIVER

[76] Inventors: Michael M. McDowell, 11201 SE. 50th Pl., Bellevue, Wash. 98006; Eugene A. Mathews, 16052 Mink Rd., Woodinville, Wash. 98072

[21] Appl. No.: 78,438

[22] Filed: Jun. 15, 1993

[51] Int. Cl.[5] ..... E02D 7/06

[52] U.S. Cl. ..... 173/1; 173/46; 173/147; 405/232

[58] Field of Search ..... 173/1, 184, 46, 147, 173/44, 81, 86; 405/232, 231, 253, 244, 229

[56] References Cited

U.S. PATENT DOCUMENTS

| | | | |
|---|---|---|---|
| 2,822,671 | 2/1958 | Dentz et al. | 173/46 |
| 3,420,320 | 1/1969 | Washita | 405/232 |
| 3,437,156 | 4/1969 | Laverty | 173/1 |
| 3,520,374 | 7/1970 | Ebert | 173/22 |
| 3,563,319 | 2/1971 | Nixon | 173/46 |
| 3,565,184 | 2/1971 | Gustafsson et al. | 173/28 |
| 3,809,344 | 5/1974 | Kolderup et al. | 248/16 |
| 4,099,579 | 7/1978 | Stormon | 173/4 |
| 4,124,081 | 11/1978 | Deike | 173/147 |
| 4,147,457 | 4/1979 | Washida | 405/232 |
| 4,858,700 | 8/1989 | Shafer | 173/22 |
| 4,889,192 | 12/1989 | Ricard | 173/22 |
| 4,938,296 | 7/1990 | Brazell, II | 173/22 |
| 4,989,677 | 2/1991 | Lam | 173/31 |

FOREIGN PATENT DOCUMENTS

| | | |
|---|---|---|
| 2340094 | 2/1974 | Germany . |
| 1436805 | 5/1976 | United Kingdom . |
| 2230807 | 10/1990 | United Kingdom . |

*Primary Examiner*—Richard K. Seidel
*Assistant Examiner*—Hwei-Siu Payer
*Attorney, Agent, or Firm*—David P. Campbell

[57] ABSTRACT

A hydraulic pile driver (9) including a backhoe (10), a lead (30), a vibratory hydraulic hammer (38), and a winch (46), for driving pin pile or needle pile (44) into the ground. The lead (30) is limited in height, as is the backhoe (10) in size, so that the pile driver (9) can be used within the interiors of many building structures. The vibratory hydraulic hammer (38) operates at a rate greater than 400 blows per minute and generates a force greater than 100 foot-pounds.

10 Claims, 4 Drawing Sheets

PILE DRIVER

TECHNICAL FIELD

This invention pertains to pile drivers for driving lengths of needle pile into the ground. More specifically, this invention pertains to a pile driving apparatus and method for driving an array of needle piles into the ground to form a support structure for a column member of a building.

BACKGROUND INFORMATION

In the construction and pile driving industry, workmen use hand-held pneumatic hammers to drive small diameter pipe piles into the ground. These small diameter piles are generally referred to as "pin pile" or "needle pile." Throughout the disclosure, reference shall be made to these piles by referring to them as needle piles. Needle piles are metal pipes of relatively small diameter, for example, from one to four inches, which are driven into the ground in an array of piles. The embedded piles form a support structure that, for example, is used to support a column member of a building.

Compressed air powers hand-held pneumatic hammers. In typical manually-operated pneumatic hammers, a force of approximately ninety foot-pounds is created to drive the needle pile into the ground. In operation, a workman drives a needle pile into the ground by bracing his feet adjacent the pile and holding the hammer above the needle pile with the hammer head maintained in contact with the top end of the pile. As the hammer pounds the pipe, the workman guides the hammer along with the pipe toward the ground while maintaining his footing as best he can. After the workman has driven a few piles into the ground, he often stands atop these piles to position himself to drive additional piles into the ground.

Alternatively, in some situations, the length of pile is greater than the length that can be controllably driven into the ground by the workman standing on the ground. For these situations, temporary scaffolding is erected on which the workman climbs to position the hammer on the top end of the longer length of needle pile. As the pile is being driven, the operator climbs down the scaffolding until the pile is driven sufficiently into the ground.

This hand-held hammer method of driving needle pile into the ground is not only labor intensive and time consuming, but is dirty, exhausting, and often dangerous for the operator of the hammer. The operator exerts a great deal of energy to maintain the hammer in line with the end of the needle pile, while attempting to maintain his footing, either on broken ground, temporary scaffolds, down in a trench, or in other adverse conditions. Because the hammer head of the hand-held pneumatic hammer is a relatively powerful tool, it can easily injure the operator or other workmen under such conditions. Consequently, the manually-operated pneumatic hammer method of driving needle pile creates a significant risk of injury to operating personnel.

In addition, pneumatic hammers are limited in the amount of force they can generate to drive needle pile. Generally, as mentioned, compressed air powered hammers generate approximately ninety foot-pounds of force. With this amount of force, driving needle pile can be a time-consuming operation. Often it can take up to an entire day to drive a single needle pile into certain types of earth.

Pile driving crane apparatus are also known for driving large diameter piles into the ground. Such cranes are used to drive concrete, steel, or wood piles of relatively large diameter, for example, eight to ten inches. Pile driving cranes typically include a large frame that supports a vertical mast or guide beam, which guides a hammer weight down along the length of the beam. The vertical mast or beam of a pile driving crane can exceed thirty feet in height. The size of these vehicles is necessary to generate and control the forces necessary to drive large diameter pile into the ground. The hammer is generally an impact hammer that operates at a rate below 400 blows per minute and generates over 385 foot-pounds of force per blow. The hammer is driven by a power source such as compressed air, steam, or a diesel engine. While such cranes function well to drive large diameter piles into the ground, they are impractical to use for driving needle piles. The forces that an impact hammer generates typically would break a needle pile. Also, it is difficult and time consuming to reposition the large crane apparatus to drive additional piles into the ground. The height of the vertical mast makes it impractical, if not impossible, to use such pile driving cranes at interior pile sites.

Vibratory hammers, which operate at a rate greater than 400 blows per minute, have been used for driving large diameter pile. However, such hammers are used on a crane-like apparatus, which is difficult to maneuver and reposition to drive an array of piles into the ground, and which, due to its size, is limited to exterior applications.

Accordingly, a principal object of the present invention is to provide a hydraulic pile driver that is safe, quick and efficient, and which is relatively compact in size and maneuverable for use in a variety of applications.

DISCLOSURE OF THE INVENTION

Briefly described, the present invention comprises a hydraulic pile driver for driving needle pile into the ground including a vibratory hydraulic hammer carried by a backhoe apparatus. The hammer includes a piston reciprocable within the hammer and a hammer head coupled to the piston for imparting a force from the piston to the top end of the needle pile. The vibratory hydraulic hammer is mounted on a lead and is slidable therealong. A device is provided for raising the hammer after a needle pile has been driven into the ground.

The lead and hammer raising device are mounted onto the boom of the backhoe. The backhoe includes a movable base, an operator cabin mounted on the movable base, and a main boom segment pivotally mounted to the base, and a forward boom segment pivotally mounted to the main boom segment. The distal end of the forward boom segment supports the lead, and the winch is mounted to the main boom segment on the top side thereof.

The vibratory hydraulic hammer is a modified hydraulic pavement breaker. The hammer point of the breaker is replaced with a hammer head adapted to fit over the end of a needle pile. The vibratory hydraulic hammer is powered by the hydraulic system of the backhoe. The hammer head vibrates at a rate greater than 400 blows per minute and generates a force in the range of 100 to 150 foot-pounds. As a result, the hammer vibrates the needle pile into the ground, rather than ramming it into the ground. Also, the hydraulic hammer generates a greater force than prior art pneumatic hammers, which significantly reduces the amount of time required for driving the piles.

The boom of the backhoe provides a fixed or stationary support for the lead while the hammer drives the needle pile. This eliminates the need for an operator to guide the hammer while driving the needle pile and, thus, reduces the risk of injury.

In preferred form, the lead is limited to fifteen feet in height so that the lead can be positioned in a vertical manner and used to drive needle piles within the interior of a building. The backhoe is a compact hydraulic excavator with the bucket removed from the boom so that the lead can be pivotally mounted to the boom via a mounting bracket. Accordingly, the backhoe and lead are sufficiently compact so that the pile driver apparatus can maneuver within the interior confines of a building. As a result, the pile driver can be used in many retrofit and add-on applications, where it is necessary to install additional vertical support columns inside a building, yet where space limitations restrict the size of equipment.

With the pile driving apparatus of the present invention, after a needle pile has been driven into the ground by the vibratory hydraulic hammer, the hammer can be easily repositioned by the boom of the backhoe in order to drive additional piles into the ground. In this manner, an array of piles can quickly and efficiently be driven into the ground in one general location in order to form a support structure for a column member of a building frame.

The pile driving apparatus can drive piles into the ground in a much quicker and safer manner than the hand-held pneumatic hammers currently used to drive needle piles. The vibratory hydraulic hammer is more powerful than compressed pneumatic hammers, and the backhoe and lead provide a fixed support apparatus for guiding the hammer, thus eliminating the need for manually controlling the hammer.

In addition, the hydraulic hammer provides sufficient driving force so that the needle piles can be fitted with end caps to seal off their embedded forward ends. End caps create a more stable base for the needle piles, thus increasing the maximum load capacity of the piles. While end caps make driving needle piles into the ground slightly more difficult, the vibratory hydraulic hammer of the present invention provides sufficient power to drive the end cap-fitted pile quickly and efficiently.

Other features and advantages of the present invention can be seen and understood by examination of the appended drawings, description of the best mode for carrying out the invention, and the claims, all of which are incorporated herein by reference as a portion of the disclosure of the present invention.

BEST MODE FOR CARRYING OUT THE INVENTION

Figure 1:
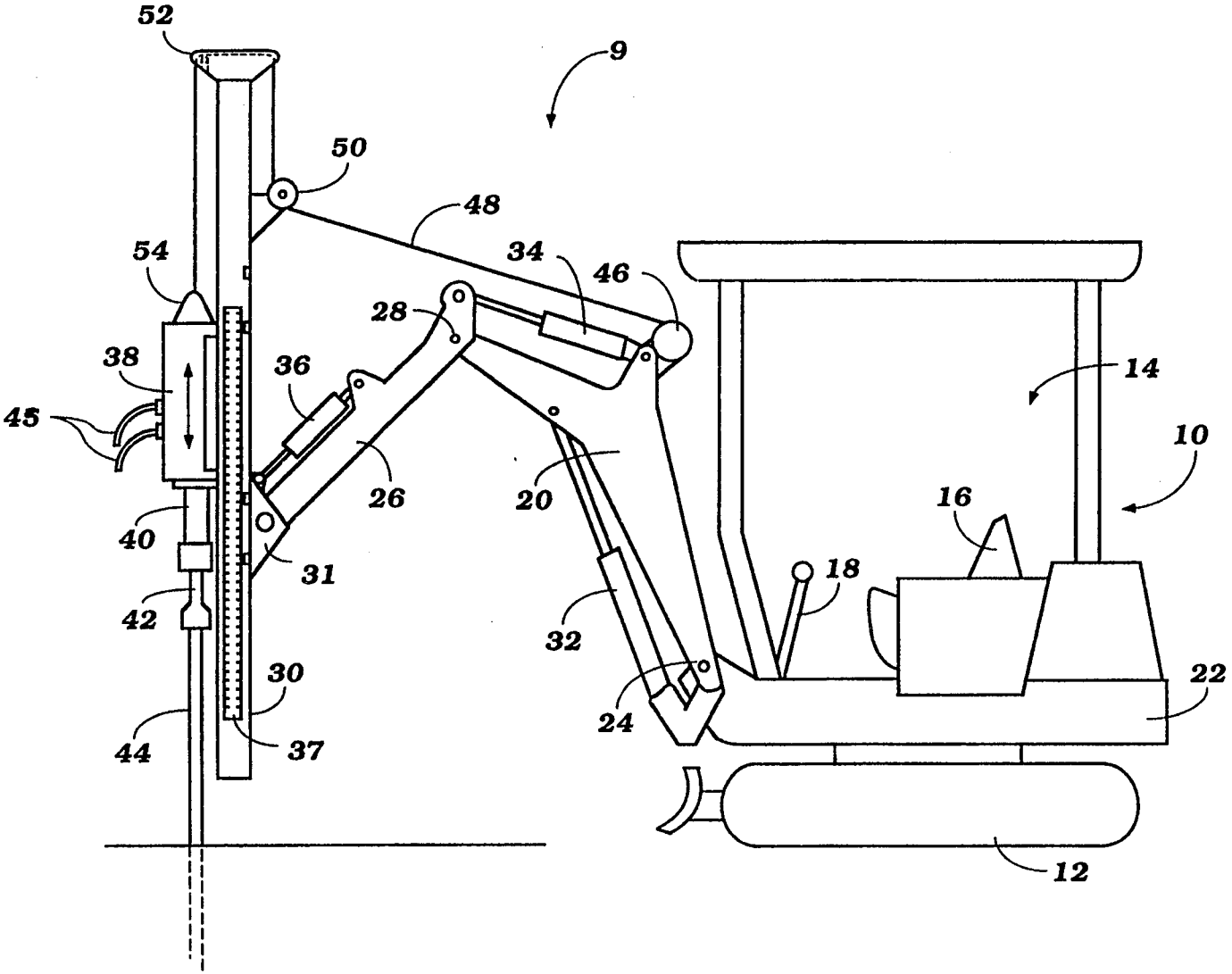
FIG. 1 is a side elevation view of the pile driving apparatus of the present invention.

Referring now to the drawings, where like numerals represent like parts throughout the several views, FIG. 1 illustrates the pile driving apparatus 9 of the present invention constructed in accordance with a preferred embodiment thereof. A backhoe is shown at 10. The backhoe 10 includes a tractor base 12 and an operator's cab 14, which includes an operator's seat 16 and controls 18. The main boom 20 of the backhoe 10 is pivotally connected to a lower frame portion 22 of the backhoe 10, at location 24. A forward boom 26 is pivotally connected to the main boom 20 at location 28. The backhoe 10 may be, for example, a BOBCAT ® Model 220, 225 or 231 compact hydraulic excavator.

A pile lead 30 is connected to the front end of the forward boom 26 by means of bracket 31. The lead 30 is an aluminum I-beam that, preferably, is fifteen feet or less in height. A hydraulic cylinder 32 moves the main boom 20 relative to the lower frame portion 22, and a hydraulic cylinder 34 moves the forward boom 26 relative to the main boom 20. In addition, a hydraulic cylinder 36 moves the lead 30 relative to the forward boom 26. Cylinders 32, 34, 36 are used for positioning the axis of the lead with respect to the ground location where a needle pile is to be driven. A scale 37 is mounted longitudinally on the lead 30. The scale is marked off in one-inch increments for purposes of determining when a needle pile is sufficiently driven into the ground.

A vibratory hydraulic hammer 38 is slidably mounted at the forward side of the lead 30. The hydraulic hammer 38 includes a pile driving head 40, which includes a hammer head 42. The hammer head 42 is adapted to engage the upper end of a needle pile 44. The needle pile 44 is a length of steel pipe that is generally from one to four inches in diameter. Hydraulic fluid is delivered to the hydraulic hammer 38 via connections 45 from the hydraulic system of the backhoe. A gas spring (not shown) is provided at the upper end of the interior chamber of the hammer. Hydraulic pressure moves an internal piston upwardly against the force of the gas spring. When hydraulic pressure is removed from the piston, the gas spring operates to force the piston downwardly. The piston and the hammer head 42 are coupled together so that the force of the piston is imparted to the hammer head and, in turn, imparted to the needle pile 44. In preferred form, the vibratory hammer 38 is a modified hydraulic pavement breaker sold by Hanix America, Inc., Bensenville, Ill., U.S.A., as Model No. HHB-05. The hammer bit of the hydraulic pavement breaker sold by Hanix is replaced with a hammer head 42 specifically adapted for use in driving pile.

A winch 46 is mounted on the main boom 20. A cable 48 extends forwardly from the winch 46, first under a guide roller 50, mounted on the back side of the lead 30, and then over guide rollers 52, mounted on the top of the lead 30, and then downwardly to a connection with the hydraulic hammer at location 54. Winch 46 is used for raising the hydraulic hammer after a needle pile has been driven into the ground.

Figure 2:
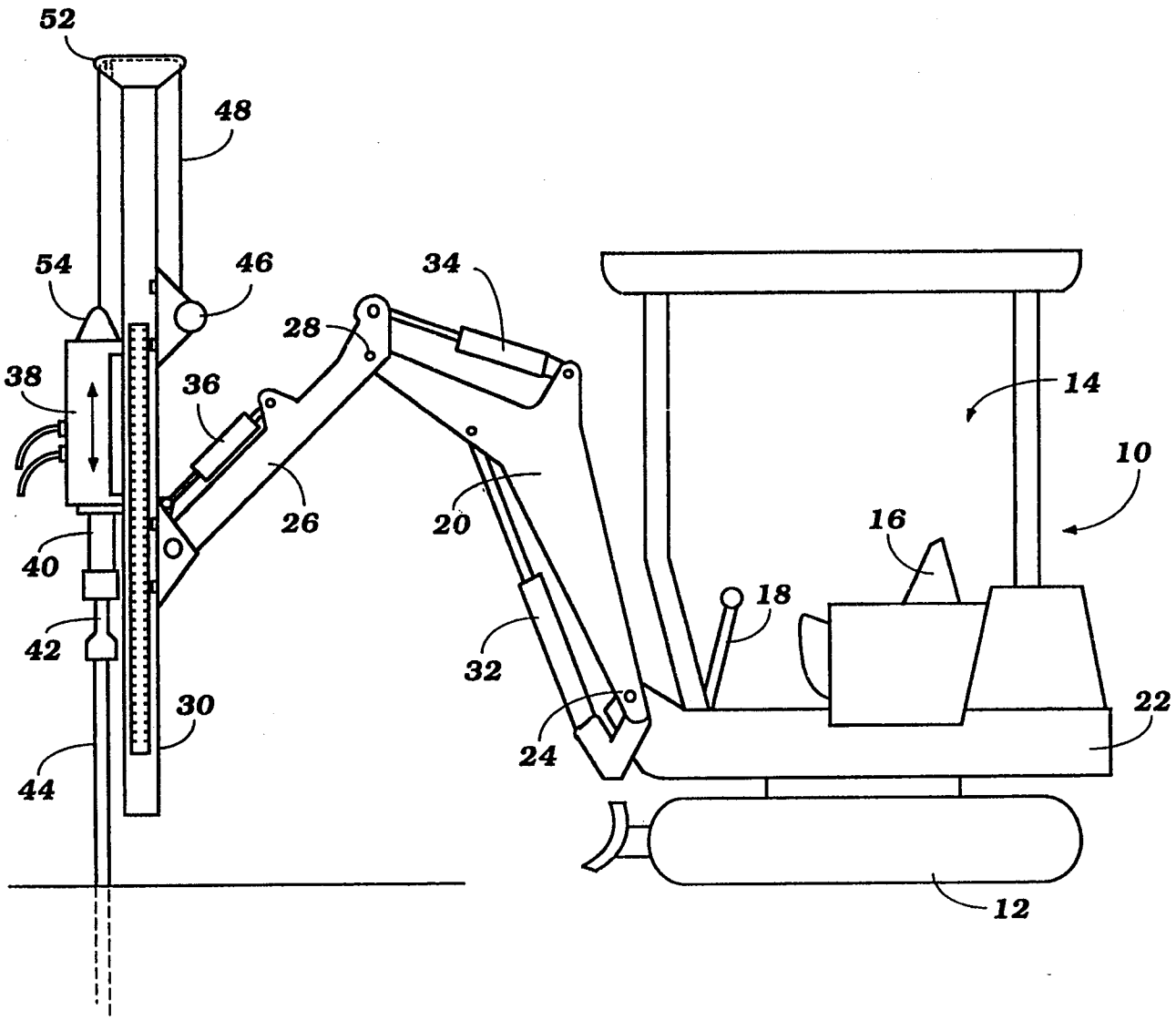
FIG. 2 is a side elevation view of the pile driving apparatus of FIG. 1 illustrating the winch mounted to the lead.

Referring to FIG. 2, in an alternative embodiment, the winch 46 can be mounted directly to the back side of the lead 30. In this configuration, the cable 48 supporting the hydraulic hammer 38 extends directly from the winch 46 over the guide rollers 52 mounted on the top of the lead 30.

Figure 3:
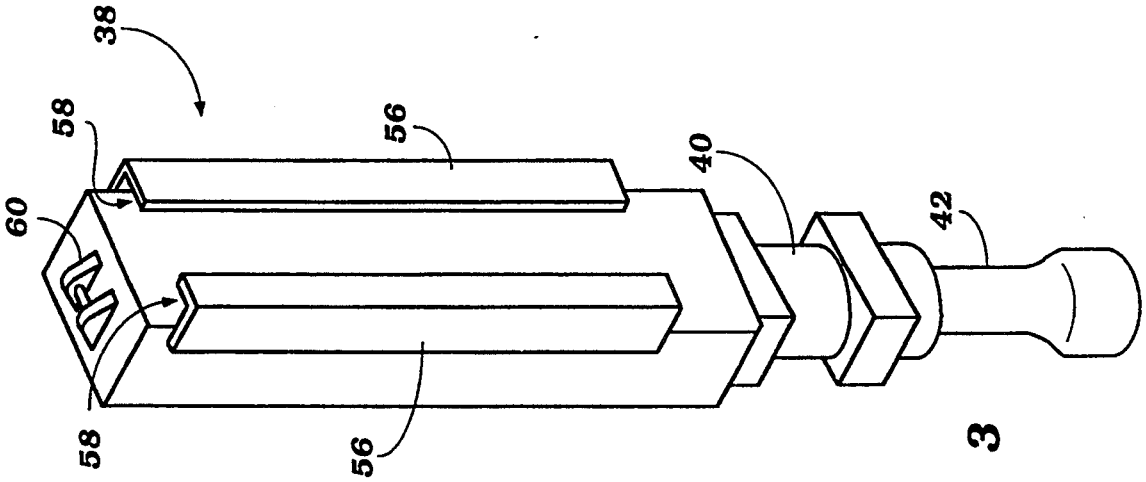
FIG. 3 is an isometric view of the back side of the hydraulic hammer illustrating the brackets used for slidably mounting the hammer on the lead.

Referring to FIG. 3, the backside of the hydraulic hammer 38 is illustrated. A pair of L-brackets 56 are mounted to the sides of the hydraulic hammer 38. The L-brackets 56 extend rearwardly of the hammer 38 and angle inwardly to create a gap 58 for slidably receiving the front side of the lead 30. The top side of the hydraulic hammer 38 includes a hook connection 60 for receiving the forward end of the cable 48 from the winch 46.

Figure 4:
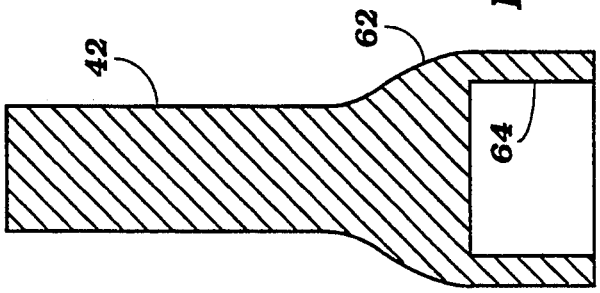
FIG. 4 is a cross-sectional view of the hammer head of the hydraulic hammer of FIG. 3.

FIG. 4 is a cross-sectional view of the hammer head 42 shown in FIG. 3. The hammer head 46 is flared at its lower end 62 and includes a hollowed-out portion 64 that is specifically sized to receive an end portion of a length of needle pile. The hammer head is secured within the pile driving head 40 by means of a retainer pin or the like (not shown).

Figure 5:
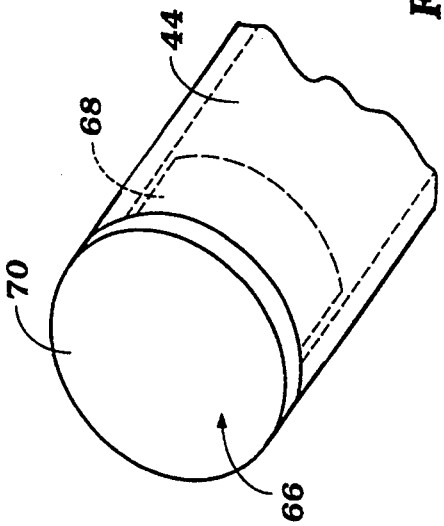
FIG. 5 is a fragmentary perspective view of a needle pile fitted with an end cap.

FIG. 5 illustrates an end cap 66 fitted at the forward end of a length of needle pile 44. The end cap includes an inner core 68 and a top 70. The end cap 66 is press-fitted into the needle pile prior to driving to fit flush with the exterior walls of the pile. The end caps 66 may be used to increase the load capacity of the piles. While the end caps 66 add resistance to driving, the hydraulic hammer 38 is sufficiently powerful to drive the piles quickly and efficiently. The quick and efficient use of end caps in conjunction with needle piles is an improvement provided by the present invention and unachievable with conventional prior art pneumatic hammers.

Figure 6:
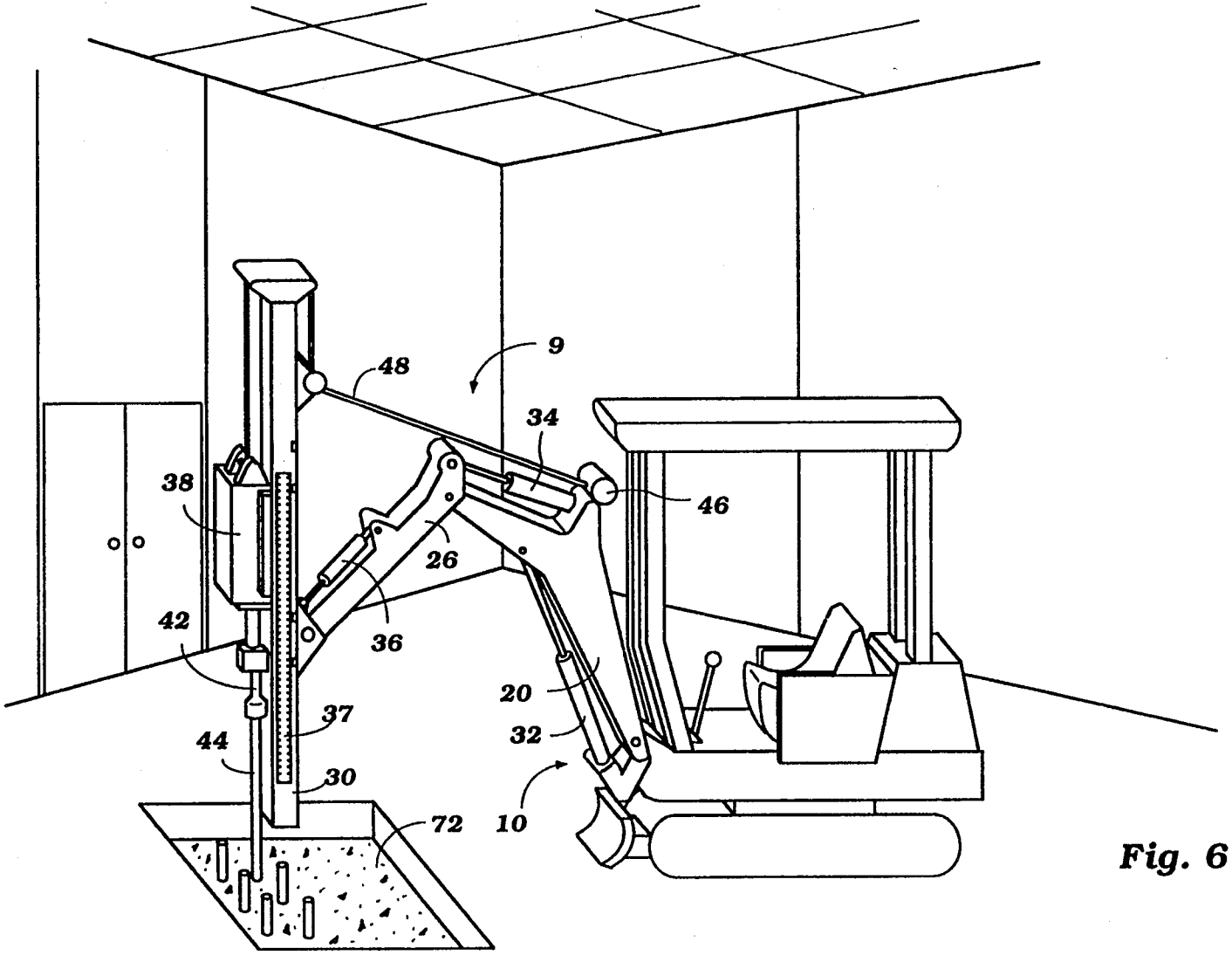
FIG. 6 is a pictorial view of the pile driving apparatus of FIG. 1 shown driving an array of piles into the ground within the interior of a building structure.

In operation, as shown in FIG. 6, the lead 30 is positioned above the ground 72 by placement of the backhoe 10. Cylinders 32, 34, 36 are operated to position the lead 30 relative to the backhoe and relative to the ground. Once the lead 30 is in position, the winch 46 is operated to raise the hammer 38. A needle pile 44 is inserted into the hollowed-out portion 64 of the hammer head 42. The other end of the needle pile 44 is positioned on the ground at the point for driving the needle pile. The hydraulic hammer 38 is then operated to provide a vibrating driving force on the needle pile 44. As the hydraulic hammer 38 drives the needle pile 44 into the ground, the weight of the hammer causes it to slide along the forward side of the lead 30 and maintain contact with the upper end of the needle pile 44. During this time, the winch 46 is operated to maintain slack in the cable 48. As the needle pile 44 nears its fully-driven position, it will become more difficult to further drive the needle pile into the ground. At such time, the vertical displacement of the needle pile is measured along the scale 37 as a function of time to determine whether the needle pile is sufficiently driven into the ground, as is well known in the art.

Once the needle pile is driven into the ground, the winch 46 is operated to again raise the hydraulic hammer 38, while the main boom 20 and forward boom 26 reposition the lead 30 for driving an additional needle pile into the ground. As shown in FIG. 6, five needle piles have been driven into the ground, while a sixth needle pile is shown being driven into the ground. In this configuration, the needle piles 44 form an array of piles that are used as a support structure for the column member of a building.

As shown in FIG. 6, the pile driving apparatus is shown being used within the interior of a building structure. This is accomplished by limiting the height of the lead 30 so that the lead can be positioned vertically with sufficient clearance between it and the ceiling structure and floor of the building. In addition, the backhoe 10 is a modified compact hydraulic excavator that is sufficiently compact to be used within the interior of most building structures. As such, the pile driving apparatus 9 is especially suitable for renovation construction projects wherein additional support columns are added within the interior of a building structure.

It is to be understood that many variations in size, shape, and construction can be made to the illustrated and herein-described embodiment without departing from the spirit and scope of the present invention. Some of the features of the preferred embodiment may be utilized without other features. Therefore, it is to be understood that the presently-described and illustrated embodiment is nonlimitive and is for illustration only. Instead, the present invention is to be limited only by the following claims interpreted according to accepted doctrines of claim interpretation, including the doctrine of equivalents and reversal of parts.

What is claimed is:

1. A pile driver for driving a length of needle pile into the ground, the needle pile being from about one to four inches in diameter, comprising a vibratory, hydraulic hammer including a hammer head for imparting a force to the needle pile, a lead for guiding the hammer toward the pile as the hammer drives the pile into the ground, a device for raising the hammer along the lead so that the hammer can be raised after a pile is driven into the ground, a backhoe including an articulated boom for fixing the lead temporarily in a stationary position while the hammer drives a needle pile into the ground and for repositioning the lead in order to reposition the hammer to drive additional piles into the ground at locations spaced from each other, wherein the backhoe comprises a movable base, a main boom segment swivelly mounted to the movable base and movable vertically and laterally, and a forward boom segment pivotally mounted to a distal end of the main boom segment, the lead being supported at a distal end of the forward boom segment, whereby an array of needle piles can be driven into the ground to form a support structure, and wherein the device for raising the hammer includes a winch mounted to the main boom segment.

2. The pile driver of claim 1, wherein the vibratory, hydraulic hammer is adapted to reciprocate at a rate greater than four hundred blows per minute.

3. The pile driver of claim 1, wherein the lead is less than twenty feet in length so that the pile driver can be used in the interior of a building structure.

4. The pile driver of claim 1, wherein the vibratory, hydraulic hammer is adapted to impart a force to the needle pile of not greater than three hundred foot-pounds.

5. A pile driver for driving a length of needle pile into the ground, the needle pile being from about one to four inches in diameter, comprising a vibratory, hydraulic hammer including a hammer head for imparting a force to the needle pile, a lead for guiding the hammer toward the pile as the hammer drives the pile into the ground, a device for raising the hammer along the lead so that the hammer can be raised after a pile is driven into the ground, a backhoe including an articulated boom for fixing the lead temporarily in a stationary position while the hammer drives a needle pile into the ground and for repositioning the lead in order to reposition the hammer to drive additional piles into the ground at locations spaced from each other, wherein the backhoe comprises a movable base, a main boom segment swivelly mounted to the movable base and movable vertically and laterally, and a forward boom segment pivotally mounted to a distal end of the main boom segment, the lead being supported at a distal end of the forward boom segment, whereby an array of needle piles can be driven into the ground to form a support structure, and wherein the device for raising the hammer includes a winch mounted to the lead.

6. A method of driving an array of needle piles into the ground, comprising the steps of:

(1) positioning one end of a needle pile on the ground, (2) positioning a vibratory hydraulic hammer at the other end of the needle pile opposite the ground, (3) hammering the needle pile into the ground by reciprocating the hammer by hydraulic pressure and imparting a force from the hammer to the end of the needle pile adjacent the hammer, (4) guiding the hammer along a lead as the hammer drives the needle pile into the ground, (5) supporting the lead in a fixed position on a boom of a backhoe apparatus, (6) raising the hammer along the lead after the hammer has driven the needle pile into the ground, (7) repositioning the boom of the backhoe apparatus, and (8) repeating steps 1–7 until an array of needle piles driven into the ground.

7. The method of claim 6, wherein the step of hammering the needle pile into the ground includes reciprocating the hammer at a rate greater than four hundred blows per minute.

8. The method of claim 6, wherein the step of hammering the needle pile into the ground includes reciprocating the hammer with sufficient hydraulic pressure to impart a force greater than ninety foot-pounds but less than three hundred foot-pounds.

9. The method of claim 6, wherein the step of raising the hammer includes lifting the hammer with a winch and cable, the winch being mounted on the backhoe apparatus.

10. The method of claim 6, wherein the step of guiding the hammer along a lead includes guiding the hammer on a lead that is less than twenty feet in length so that the lead can be utilized within the interior of a building.

* * * * *

UNITED STATES PATENT AND TRADEMARK OFFICE

CERTIFICATE OF CORRECTION

PATENT NO. : 5,375,664

DATED : December 27, 1994

INVENTOR(S) : Michael M. McDowell et al

It is certified that error appears in the above-indentified patent and that said Letters Patent is hereby corrected as shown below:

Claim 6, column 8, line 10, insert —is— before "driven".

Signed and Sealed this

Thirteenth Day of June, 1995

*Attest:*

BRUCE LEHMAN

*Attesting Officer*

*Commissioner of Patents and Trademarks*